United States Patent [19]

Fujita

[11] Patent Number: 4,520,502

[45] Date of Patent: May 28, 1985

[54] SPEECH SYNTHESIZER

[75] Inventor: Sumio Fujita, Tokyo, Japan

[73] Assignee: Seiko Instruments & Electronics, Ltd., Tokyo, Japan

[21] Appl. No.: 372,282

[22] Filed: Apr. 27, 1982

[30] Foreign Application Priority Data

Apr. 28, 1981 [JP] Japan ..... 56-64633

[51] Int. Cl.[3] ..... G10L 1/00

[52] U.S. Cl. ..... 381/51

[58] Field of Search ..... 381/51-53, 381/34; 364/513, 513.5

[56] References Cited

U.S. PATENT DOCUMENTS

| | | | |
|---|---|---|---|
| 3,109,070 | 10/1963 | David et al. | 381/51 |
| 4,344,148 | 8/1982 | Brantingham et al. | 381/51 |
| 4,374,302 | 2/1983 | Vogten et al. | 381/51 |
| 4,435,832 | 3/1984 | Asada et al. | 381/34 |

*Primary Examiner*—E. S. Matt Kemeny

*Attorney, Agent, or Firm*—Robert E. Burns; Emmanuel J. Lobato; Bruce L. Adams

[57] ABSTRACT

In a pitch synchronous speech synthesizer, an output signal from a pitch phase detector is applied to a delay circuit in a digital filter portion to initialize the output contents of the delay circuit at zero for each pitch period. In this manner the sequence of neighboring frames is smoothed.

2 Claims, 8 Drawing Figures

| word | amplitude | pitch (ms) | repeat time | | PARCOR Coefficient | | Speech Waveform |
|---|---|---|---|---|---|---|---|
| S | 4 | 6.3 | 9 | Unvoiced Sound | K 1 | −0.02808 | Omitted |
| | | | | | 2 | 0.42598 | |
| | | | | | 3 | −0.43675 | |
| | | | | | 4 | 0.31135 | |
| | | | | | 5 | −0.05985 | |
| | | | | | 6 | 0.60106 | |
| | | | | | 7 | 0.00000 | |
| | | | | | 8 | 0.00000 | |
| | | | | | 9 | 0.00000 | |
| | | | | | K 10 | 0.00000 | |
| i | 43 | 2.7 | 8 | Voiced Sound | K 1 | −0.97620 | Pitch Waveform 101 |
| | | | | | 2 | 0.82662 | |
| | | | | | 3 | 0.18506 | |
| | | | | | 4 | 0.71545 | Frame Waveform 102 |
| | | | | | 5 | 0.23789 | |
| | | | | | 6 | 0.26356 | |
| | | | | | 7 | −0.59392 | |
| | | | | | 8 | 0.79369 | (Fig. 3) |
| | | | | | 9 | −0.62511 | (Fig. 4) |
| | | | | | K 10 | 0.02695 | |
| | 132 | 3.0 | 8 | | K 1 | −0.96921 | Pitch Waveform 103 |
| | | | | | 2 | 0.62398 | |
| | | | | | 3 | 0.07892 | |
| | | | | | 4 | 0.83529 | Frame Waveform 104 |
| | | | | | 5 | 0.04218 | |
| | | | | | 6 | 0.16590 | |
| | | | | | 7 | −0.48534 | |
| | | | | | 8 | 0.67281 | (Fig. 3) |
| | | | | | 9 | −0.38987 | (Fig. 4) |
| | | | | | K 10 | −0.31407 | |

FIG. 5

| word | amplitude | pitch (ms) | repeat time | | PARCOR Coefficient | | Speech Waveform |
|---|---|---|---|---|---|---|---|
| Se | | | | | Omitted | | Omitted |
| i | 63 | 2.6 | 4 | Voiced Sound | K 1 | −0.88394 | Pitch Waveform 105 |
| | | | | | 2 | 0.05020 | |
| | | | | | 3 | −0.25550 | |
| | | | | | 4 | 0.61144 | Frame Waveform 106 |
| | | | | | 5 | 0.15833 | |
| | | | | | 6 | 0.57787 | |
| | | | | | 7 | −0.38298 | |
| | | | | | 8 | 0.25428 | (Fig. 6 / Fig. 7) |
| | | | | | 9 | −0.15732 | |
| | | | | | K 10 | 0.18238 | |
| | 82 | 2.8 | 8 | | K 1 | −0.96179 | Pitch Waveform 107 |
| | | | | | 2 | 0.61232 | |
| | | | | | 3 | 0.25132 | |
| | | | | | 4 | 0.65056 | Frame Waveform 108 |
| | | | | | 5 | −0.02383 | |
| | | | | | 6 | 0.34193 | |
| | | | | | 7 | −0.31321 | |
| | | | | | 8 | 0.35835 | (Fig. 6 / Fig. 7) |
| | | | | | 9 | −0.27259 | |
| | | | | | K 10 | 0.14322 | |
| | 52 | 2.6 | 8 | | K 1 | −0.97031 | Pitch Waveform 109 |
| | | | | | 2 | 0.78967 | |
| | | | | | 3 | 0.24918 | |
| | | | | | 4 | 0.78909 | Frame Waveform 110 |
| | | | | | 5 | −0.00571 | |
| | | | | | 6 | 0.21882 | |
| | | | | | 7 | −0.59758 | |
| | | | | | 8 | 0.84310 | (Fig. 6 / Fig. 7) |
| | | | | | 9 | −0.37324 | |
| | | | | | K 10 | −0.57213 | |

FIG. 8

SPEECH SYNTHESIZER

BACKGROUND OF THE INVENTION

The present invention relates to a speech synthesizer based on speech analysis and synthesis of a linear predictive coding techniques represented by PARCOR (Partial Autocorrelation) technique.

In a speech synthesizer, the synthesizing parameters necessary for synthesizing a speech in each frame are: amplitude; pitch; repeat cycle; discrimination between voiced sound and unvoiced sound; PARCOR coefficient; etc. For smoothing the sequence of the synthesizing parameters between frames, the interpolation process is executed to obtain an excellent synthesizing sound quality as disclosed in Japanese Patent Application No. Sho 56-11871 (11871/81).

A computing portion which produces a synthesized speech using the synthesizing parameters comprises a digital filter portion. If the computing data of a former frame remains within the digital filter portion in case it starts a computation, there would be a bad influence on the coming computation. More specifically, when the output from the digital filter portion is listened to as a speech through a D-A converter, the expected speech is not synthesized but instead noisy sounds which painfully affect the listener's ears are produced. Therefore, it is necessary to initialize the digital filter at the start of each frame.

By this initialization, a new frame computation which is not affected by the former frame data starts.

The "interpolation process" means that the synthesizing parameters of the former frame approach the synthesizing parameters of the latter frame in accordance with a change with the passage of time, when voiced sound frames are repeated. A smooth sequence of speech can be realized by this interpolation. In a pitch synchronous synthesizer made up of frames based on pitch period as the speech synthesizer according to the present invention, however, the sequences of the neighboring frames are sometimes unnatural only by frame initialization which resets a delay circuit at the start of each frame. Accordingly, "words" or "sentences" are unnatural and painfully the ears of the listener.

SUMMARY OF INVENTION

Accordingly, the present invention aims to eliminate the above noted drawbacks, and therefore it is an object of the present invention to provide a pitch synchronous speech synthesizer, in which each pitch is initialized (pitch initialization) periodically for improving the sequence of the neighboring frames so that the "words" after the pitch initialization may become more natural acoustically than the "words" after frame initialization, and may more closely resemble an original speech.

These and other objects, features and advantages of the invention will become more apparent upon a reading of the following detailed description in conjunction with the accompanying and drawing.

BRIEF DESCRIPTION OF THE DRAWINGS

FIG. 5 shows the synthesizing parameters of the synthesizing speech waveform, FIG. 8 shows the synthesizing parameters of the synthesizing speech waveforms in FIGS. 6 and 7.

PREFERRED EMBODIMENT OF THE INVENTION

Figure 1:
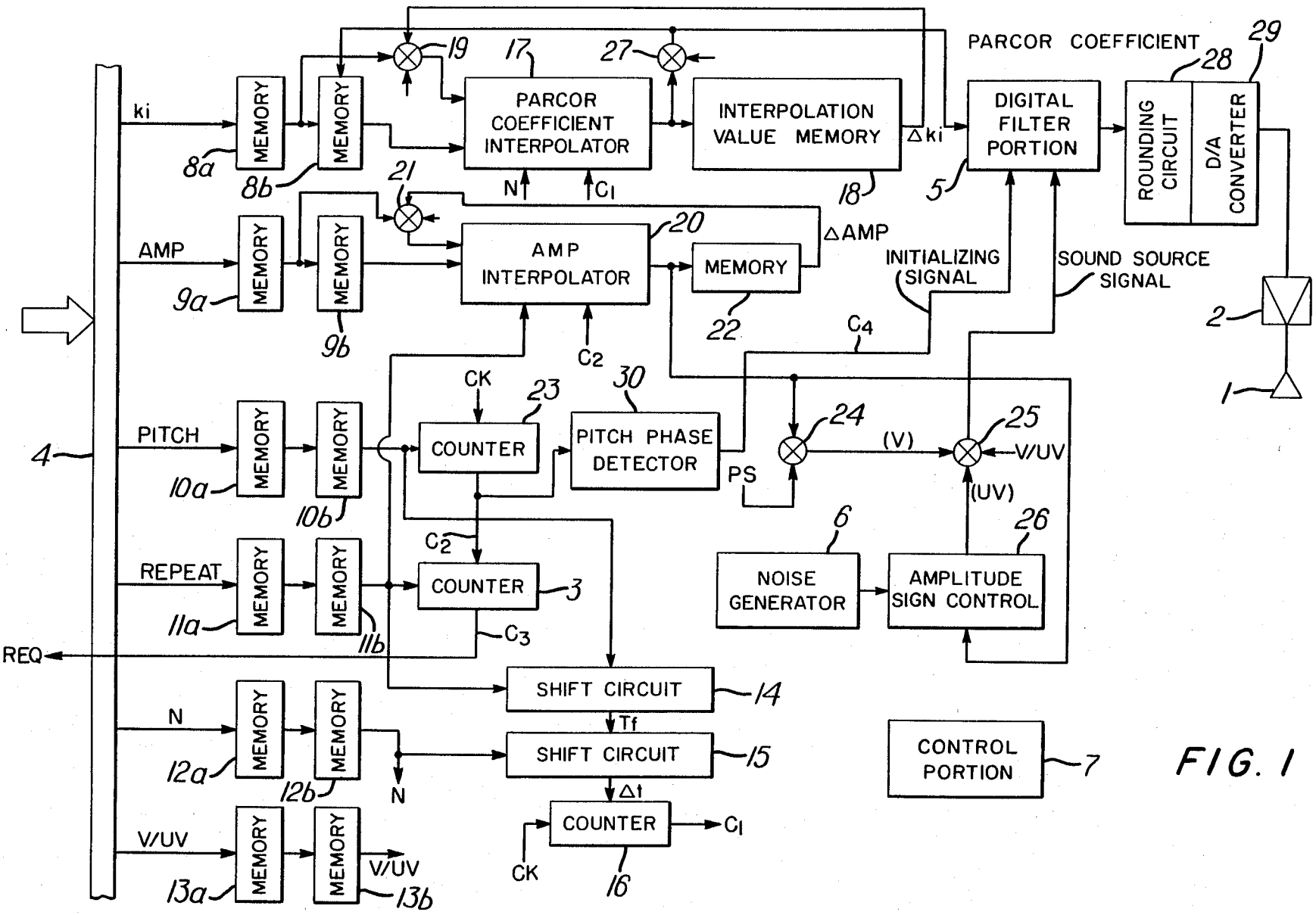
FIG. 1 is a block diagram of a speech synthesizer according to the present invention.

FIG. 1 is a block diagram of a synthesizing circuit which is an essential portion of a speech synthesizer according to the present invention. The synthesizing circuit comprises a circuit comprised of a shift circuit 14 for obtaining frame intervals from the pitch data (PITCH) and the repeat line data (REPEAT) and producing a corresponding frame interval signal Tf; a pitch period generator comprised of a counter 23 and a pitch phase detector 30; an AMP interpolation circuit 20; a change-over switch 21; a memory 22; an interpolation circuit made up of a PARCOR coefficient interpolator 17, an interpolation value memory 18, and change-over switches 19 and 27 and the like; a counter 23; an interpolation timing signal generator made up of shift circuits 14 and 15, and a counter 16; and a synthesizing circuit portion made up of a digital filter portion 5 and the like. The pitch period generator comprises the presettable down counter 23 for storing pitch data in a memory **10*b* and the pitch phase detector 30 which detects count up signals $C_2$ produced per each pitch time from the counter 23 and generates initializing signals which are synchronized with the operation of the digital filter portion 5**.

A detailed description of the function and operation of the other circuits shown in FIG. 1 are as disclosed in Japanese Patent Application No. Sho 56-11871 (11871/81) and therefore a description thereof has been omitted herein.

Figure 2:
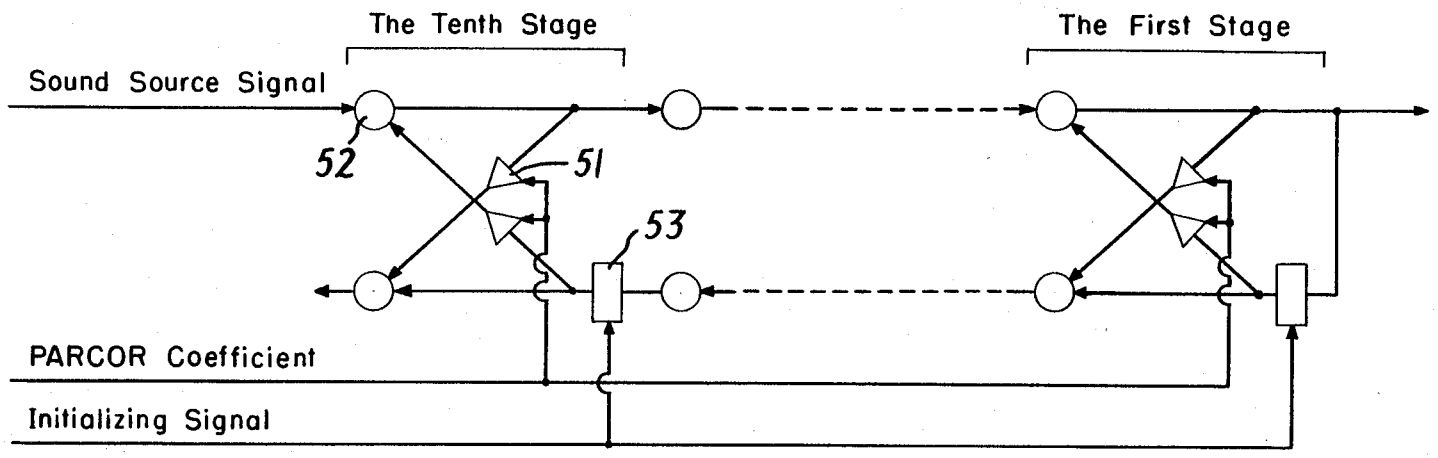
FIG. 2 is an embodiment of a digital filter.

FIG. 2 shows an embodiment of the digital filter portion 5 shown in FIG. 1. The digital filter portion 5 is a 10 stage digital filter and each stage comprises two multipliers 51, two adders 52 and a delay circuit 53. A signal $C_3$ produced from a repeat counter 3 is fed to the digital filter portion 5 as a frame initializing signal, while a signal $C_4$ produced from the pitch period generator made up of the pitch counter 23 and the pitch phase detector 30 is fed to the digital filter portion 5 as a pitch initializing signal. The initializing signal $C_4$ resets the delay circuit 53 and decides an initial condition within the digital filter portion 5.

Figure 3:
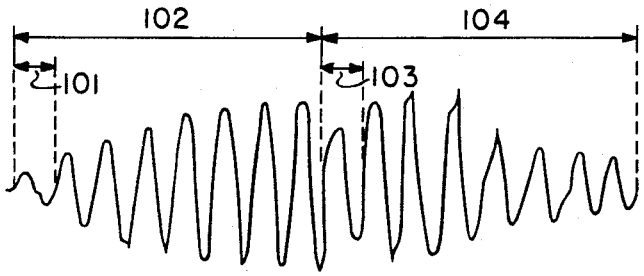
FIG. 3 is a synthesized speech waveform by initializing a frame.
Figure 4:
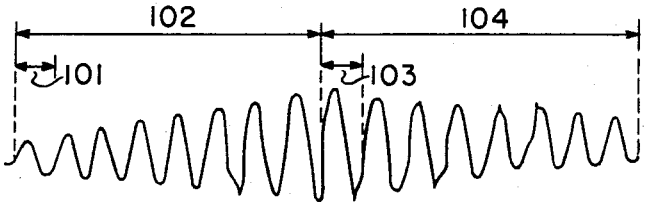
FIG. 4 is a synthesized speech waveform by initializing a pitch, where the abscissa, i.e., the time axis in FIG. 3 coincides with the time axis in FIG. 4 and the same synthesizing parameters are used in FIGS. 3 and 4.

FIGS. 3 and 4 show waveforms extracting a sound "-s-i" from a word "w-a-t-a-s-i-w-a". FIG. 3 shows a waveform after frame initialization and FIG. 4 shows a waveform after pitch initialization. FIG. 5 shows the synthesizing parameters for synthesizing the waveforms in FIGS. 3 and 4. The frame of an unvoiced sound "s" is omitted in the Figures. One pitch is a waveform of one period corresponding to waveforms 101 and 103 respectively. One frame is defined as (one pitch waveform) X (repeat time) corresponding to 102 and 104 respectively. Subsequently the waveforms are correspondent to the synthesizing parameters. Since the waveform 101 is a first one-pitch of the frame 102, the delay circuit 53 is initialized by the initializing signal shown in FIG. 2, and the waveform 101 is not affected by the calculation data of the former frame, whereby FIGS. 3 and 4 show the same waveforms. The one-pitch waveform 103 in the next frame 104 has the same result. The waveform of each pitch of the frame 102 gradually enlarges because the amplitude and the PARCOR coefficient are directly interpolated in relation to the amplitude and the PARCOR coefficient of the next frame. Since FIG. 3 shows the waveform after the frame initialization, the initializing signals are not applied to the delay circuit 53 of the digital filter portion 5 during an interval corresponding to seven-pitches subsequent to the initial one-pitch waveform 101.

The speech waveform corresponding to seven-pitches subsequent to the waveform 101 synthesizes a speech by using the calculation data of the former pitch waveform at any instant of time. Namely, the computing data accumulated in the delay circuit 53, computed without reset, is gradually accumulated as errors and produces an unnatural sequence of the interpolated last pitch of the waveform and the initial one-pitch waveform 103 in the next frame 104. Since FIG. 4 shows the waveform after the pitch initialization, the initializing signals are fed to the delay circuit 53 each pitch period. Accordingly the above calculation data accumulated in the delay circuit 53 is not used for the speech waveform corresponding to seven-pitches subsequent to the waveform 101. As a result, the accumulation of the errors is eliminated and the interpolated last pitch of the waveform is smoothly sequenced to the initial one pitch waveform 103 in the next frame 104.

Figure 6:
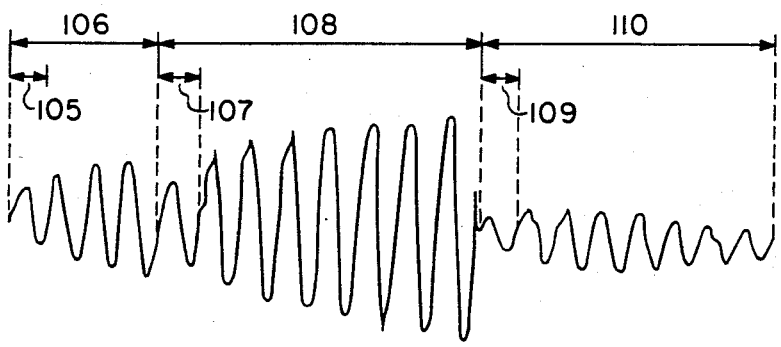
FIG. 6 shows a synthesizing speech waveform by initializing frames.
Figure 7:
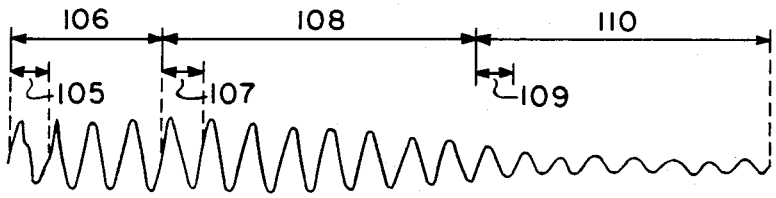
FIG. 7 shows a synthesizing speech waveform by initializing pitches, where the abscissa, i.e., the time axis in FIG. 6 coincides with the time axis in FIG. 7 and the same synthesizing parameters are used in FIGS. 6 and 7.

FIGS. 6 and 7 show more remarkable examples. FIG. 6 shows a waveform after frame initialization and FIG. 7 shows a waveform after pitch initialization. The waveforms represent a sound "-i-" from the word "SEIKO". The synthesizing parameters of the sound "i" are shown in FIG. 8. As shown in FIG. 6, the speech waveform 105 of 2.6ms/one pitch (interpolated in turn) repeated 4 times is not smoothly sequenced to the next frame 108. This is the same phenomena as in FIG. 3. Further, as shown in FIG. 8, in the next frame 108 and the next frame 110, the amplitude reduces from 82 to 52. This shows that the amplitude becomes gradually smaller by interpolating the frame 108. Namely the waveform becomes the speech waveform in FIG. 7 after pitch initialization. On the other hand an adverse phenomena is produced in the waveform in FIG. 6 after frame initialization. Accordingly the speech "SEIKO" after frame initialization is unnatural and painfully affects the listener's ears.

As illustrated, a synthesized speech more similar to an original speech is produced by initializing the pitches in the pitch synchronous synthesizer.

The "PARCOR coefficient" used in the disclosure is, more precisely, a reflection coefficient, whose values are well known in the art.

What is claimed is:

1. A speech synthesizer using variable frame lengths obtained by multiplication of a pitch period analyzed from original speech data by the number of repetitions of substantially the same waveform as that in the pitch period comprising: first circuit means for determining a frame interval from pitch data and repeat time data in the speech data and producing a corresponding frame interval signal; second circuit means responsive to the frame interval signal for generating a PARCOR coefficient interpolation timing signal for each PARCOR coefficient interpolation; pitch period generating means connected to receive the pitch data for generating an amplitude interpolation timing signal; third circuit means for interpolating a PARCOR coefficient in response to the PARCOR coefficient interpolation timing signal and for interpolating an amplitude value in response to the amplitude interpolation timing signal; digital filter means connected to receive the interpolated PARCOR coefficient data and the interpolated amplitude data for filtering the data, the digital filter means including resettable delay circuit means connected to the pitch period generating means for producing an initializing signal each pitch period to reset the delay circuit means; and acoustic means for producing a speech sound in response to the data output from the digital filter means.

2. A speech synthesizer according to claim 1; wherein the pitch period generating means comprises a presettable down counter connected to receive the pitch data and produce the amplitude interpolation timing signal, and a pitch phase detector responsive to the amplitude interpolation timing signal for producing each pitch period a pitch initializing signal which is applied to the delay circuit means.

* * * * *